US012611707B2

(12) United States Patent
Zafari et al.

(10) Patent No.: US 12,611,707 B2
(45) Date of Patent: Apr. 28, 2026

(54) INSULATING DIE PLATE, FORGING PRESS AND CERAMIC INSULATING BODY

(71) Applicant: SMS group GmbH, Duesseldorf (DE)

(72) Inventors: Ali Zafari, Moenchengladbach (DE); Andreas Brenner, Moenchengladbach (DE); Stephan Ackermann, Moenchengladbach (DE); Axel Rossbach, Moenchengladbach (DE); Erdem Karakas, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 360 days.

(21) Appl. No.: 18/205,635

(22) Filed: Jun. 5, 2023

(65) Prior Publication Data

US 2023/0398595 A1 Dec. 14, 2023

(30) Foreign Application Priority Data

Jun. 14, 2022 (DE) ..... 10 2022 114 968.4

(51) Int. Cl.
*B21D 37/16* (2006.01)
*B21D 37/10* (2006.01)

(52) U.S. Cl.
CPC ..... *B21D 37/16* (2013.01); *B21D 37/10* (2013.01)

(58) Field of Classification Search
CPC .. B21D 37/16; B21D 37/10; B21J 9/02; B21J 13/02; B21J 13/03
See application file for complete search history.

(56) References Cited

U.S. PATENT DOCUMENTS 3,926,029 A 12/1975 Abson et al.
6,127,006 A * 10/2000 Schulz ..... C23C 14/083 427/255.31

(Continued)

FOREIGN PATENT DOCUMENTS

CN 105461295 A 4/2016
DE 197 43 904 A1 4/1999

(Continued)

OTHER PUBLICATIONS

Winfried Nester, "Stressing cup-shaped reverse extrusion dies made of ceramics due to mechanical stress and temperature", Berlin, Heidelberg: Springer 1986 in reports from the Institute for Forming Technology of the University of Stuttgart: 1986; ISBN 978-3-540-16845-4, total of 10 pages. (see p. 3 of the specification for relevance).

(Continued)

*Primary Examiner* — Teresa M Ekiert
(74) *Attorney, Agent, or Firm* — Collard & Roe, P.C.

(57) ABSTRACT

An insulating die plate includes two parallel end plates and an insulating layer arranged therebetween which includes ceramic insulating bodies. An insulating body plane parallel to the end plates is defined for the insulating layer. Intermediate spaces are arranged on the insulating body plane between the insulating bodies. A total insulating layer area includes at least surface insulating body portions and surface intermediate space portions. In each section through the insulating bodies parallel to the insulating body plane, an insulating body surface portion in the total insulating layer area is at least 50%, the insulating bodies are symmetrically formed, with the top side equal to the bottom side of the insulating body and each insulating body designed as a plate having a height and a maximum width at least 2.5 times (Continued)

wider than the height of the insulating body; and/or the insulating bodies are anisotropically shaped.

11 Claims, 3 Drawing Sheets

(56) References Cited

U.S. PATENT DOCUMENTS

| | | | | |
|---|---|---|---|---|
| 2003/0046970 | A1* | 3/2003 | Fahrenbach ..... | B21D 45/02<br>72/345 |
| 2006/0156783 | A1 | 7/2006 | Bergue et al. | |

FOREIGN PATENT DOCUMENTS

| | | | |
|---|---|---|---|
| DE | 60 2006 000 241 | T2 | 10/2008 |
| DE | 10 2014 219 442 | A1 | 3/2016 |
| DE | 20 2021 104 680 | U1 | 11/2021 |
| JP | S57-49038 | U | 3/1982 |
| JP | H04-246514 | A | 9/1992 |
| JP | 2007-313864 | A | 12/2007 |
| JP | 2010-105044 | A | 5/2010 |
| JP | 2013-049071 | A | 3/2013 |

OTHER PUBLICATIONS

Alfred Hecht et al., "Elektrokeramik", Berlin Heidelberg: Springer 1976; ISBN 978-3-642-80950-7, total of 18 pages. (see p. 3 of the specification for relevance).

German Office Action dated Sep. 11, 2024 in German Application No. 10 2022 114 968.4, with English translation of the relevant parts.

* cited by examiner

INSULATING DIE PLATE, FORGING PRESS AND CERAMIC INSULATING BODY

CROSS REFERENCE TO RELATED APPLICATIONS

Applicant claims priority under 35 U.S.C. § 119 of German Application No. 10 2022 114 968.4 filed Jun. 14, 2022, the disclosure of which is incorporated by reference.

BACKGROUND OF THE INVENTION

1. Field of the Invention

The invention relates to an insulating die plate comprising two end plates arranged in parallel with one another and comprising an insulating layer arranged between the two end plates, which comprises ceramic insulating bodies, wherein an insulating body plane arranged at least parallel to the end plates is defined for the insulating layer, wherein the insulating bodies are arranged spaced apart next to one another on the insulating body plane, whereby intermediate spaces are arranged on the insulating body plane between the insulating bodies, wherein a total area of the insulating layer comprises at least surface portions of the insulating bodies and surface portions of the intermediate spaces. The invention also relates to a forging press for pressing a semi-finished product in a pressing direction comprising a press tappet and comprising at least one drawbar and comprising at least one upper die and one lower die, wherein each of the dies comprises a cold die part and a hot die part, wherein each of the dies comprises an insulating die plate arranged perpendicular to the pressing direction, wherein the die plate is respectively arranged between the cold die part and the hot die part, wherein each of the die plates is arranged between a cold cover side situated on the side of the cold die part and a hot cover side situated on the side of the hot die part. Likewise, the invention relates to a forging press for pressing a semi-finished product in a pressing direction comprising a press tappet and comprising at least one drawbar and comprising at least one upper die and a lower die, wherein each of the dies comprises a cold die part and a hot die part, wherein each of the dies comprises an insulating layer arranged perpendicular to the pressing direction, wherein the insulating layer is respectively arranged between the cold die part and the hot die part, wherein each of the insulating layers is arranged between a cold cover side situated on the side of the cold die part and a hot cover side situated on the side of the hot die part, wherein the insulating layer comprises ceramic insulating bodies, wherein an insulating body plane arranged at least parallel to the end plates is defined for the insulating layer, wherein the insulating bodies are arranged next to one another spaced apart on the insulating body plane, whereby, on the insulating body plane, intermediate spaces are formed between the insulating bodies on the insulating body plane, wherein a total area of the insulating layer comprises at least surface portions of the insulating bodies and surface portions of the intermediate spaces. In addition, the invention comprises a ceramic insulating body for insulating within a die of a forging press.

2. Description of the Related Art

Forging presses and, in particular, isothermal forging presses are also generally known from prior art. Here, isothermal forging presses are used, for example, to isothermally forge near-net-shape metal semi-finished products under vacuum. These methods can also be referred to as HIF methods (hot isothermal forging), wherein, for example, titanium or molybdenum materials or so-called superalloys can be forged into a shape at high temperatures with low deformation rates under superplastic conditions.

A characteristic of isothermal forging with appropriate forging presses is that forging takes place even at high and constant temperatures within the forming area. For this reason, it is necessary that the materials near the forming area are particularly heat-resistant. The embodiment of all the dies of a forging press made of a correspondingly heat-resistant material has proven not to be economical, seeing that this is particularly expensive. For this reason, only an area close to the forming area is usually made of correspondingly expensive heat-resistant materials. However, since the remaining elements of the forging press or the dies should be protected from the relatively high temperatures, it is known from the prior art to isolate the less heat-resistant areas from the particularly high temperatures within the dies. This insulation is known to take the form of an insulating layer extending across the entire surface of the die to isolate the entire area of the die to be insulated from the area of the die with particularly high temperatures.

In the forging press of US 2006/0156783 A1 or DE 60 2006 000241 T2, for example, an insulating layer is composed of two materials. The first material is a ceramic, wherein a plurality of high and narrow ceramic turrets arranged next to one another are arranged on a second material, which is designed as hot-pressed mica paper. JP 2013-049071 A also discloses relatively cube-like ceramic bodies as components of an insulating layer for a forging press.

From DE 20 2021 104 680 U1, for example, it is known to assemble the insulating bodies of the insulating layer from three individual bodies, wherein two plate-like bodies with different top sides and bottom sides are connected via a cylindrically formed bodies centrally between the two plate-like bodies in such a way that the embodiment of the insulating body resembles a dumbbell-like structure.

Deviating from this, U.S. Pat. No. 3,926,029 discloses a forging press, each with exactly a single flat insulating body within an insulating layer.

Various ceramics are discussed by NESTER, Winfried (stressing cup-shaped reverse extrusion dies made of ceramics due to mechanical stress and temperature. Berlin, Heidelberg: Springer 1986 in reports from the Institute for Forming Technology of the University of Stuttgart: 86; —ISBN 978-3-540-16845-4), wherein, in particular, in a table on page 24, different material properties, such as density, porosity, average grain size, modulus of elasticity, compressive strength, flexural strength, hardness, thermal coefficient of expansion, thermal conductivity, specific heat capacity and thermal diffusivity of $ZrO_2$, $Al_2O_3$ and $SiN_4$, among other compounds, are compared with one another. According to Hecht et al. (Elektrokeramik. Berlin Heidelberg: Springer 1967 ISBN 978-3-642-80950-7) and there, in particular, according to page 7, $3^{rd}$ paragraph, the proportion of soapstone, silica and magnesium oxide can be varied within a wide range of limits in order to achieve certain mechanical and thermal properties.

In forging presses and, in particular, via forging-press dies, very high levels of force are naturally transmitted by means of the forging method. Therefore, not only high demands are placed on all materials of the dies in terms of temperature compatibility but also in terms of compressive strength or other mechanical properties, in order to be able to reliably transfer high levels of force. For a particularly good insulating effect, it is known from the prior art, such as from DE 20 2021 104 680 U1, from DE 60 2006 000241 T2 and from US 2006/0156783 A1 for example, to use ceramic materials as insulating bodies. However, in addition to relatively different thermal properties, ceramic materials also have relatively different mechanical properties in comparison with metallic materials. In particular, care should be taken to ensure that ceramic insulating bodies are also able to counter or transfer the high forming forces without damage.

SUMMARY OF THE INVENTION

The object of the present invention is to provide the most effective insulation possible with the most effective force or pressure transmission.

The object of the invention is achieved by means an insulating die plate, a forging press and by a ceramic insulating body having the features of the independent claims. Where applicable, also independently thereof, further favorable embodiments can be found in the dependent claims and the following description.

In order to provide the most effective insulation possible with the most effective force or pressure transmission, a forging press for pressing a semi-finished product in a pressing direction comprising a press tappet and comprising at least one drawbar as well as comprising at least one upper die and one lower die, wherein each of the dies comprises a cold die part and a hot die part, wherein each die comprises an insulating layer arranged perpendicular to the pressing direction, wherein the insulating layer is respectively arranged between the cold die part and the hot die part, wherein the insulating layer is arranged between a cold cover side situated on the side of the cold die part and a hot cover side situated on the side of the hot die part, wherein the insulating layer comprises ceramic insulating bodies, wherein an insulating body plane arranged at least parallel to the end plates is defined for the insulating layer, wherein the insulating bodies are arranged next to one another spaced apart on the insulating body plane, whereby, on the insulating body plane between the insulating bodies, intermediate spaces are formed, wherein a total area of the insulating layer comprises at least surface portions of the insulating bodies and surface portions of the intermediate spaces, characterized in that, on each insulating body plane, a plurality of insulating bodies are arranged, wherein, in each section through the insulating bodies parallel to the insulating body plane, a surface portion of the insulating bodies of the total area of the insulating layer is at least 50%.

In order to provide the most effective insulation with the most effective force or pressure transmission possible, an insulating die plate with two end plates arranged parallel to each other and with an insulating layer arranged between the two end plates, which comprises ceramic insulating bodies, wherein an insulating body plane at least parallel to the end plates is defined for the insulating layer, wherein the insulating bodies are arranged spaced apart next to each one another on the insulating body plane, whereby, on the insulating body plane between the insulating bodies, intermediate spaces are formed, wherein a total area of the insulating layer comprises at least surface portions of the insulating bodies and surface portions of the intermediate spaces, can also accordingly be characterized in that, in each section through the insulating bodies parallel to the insulating body plane, a surface portion of the insulating bodies of the total area of the insulating layer is at least 50%.

In the case of a suitable embodiment, the above-mentioned design also allows a long service life of the assemblies involved, in particular the insulating bodies since the forces can then be distributed as uniformly as possible to the insulating bodies.

In the present context, a "forging press" can be understood, in particular, as an isothermal forging press in which a semi-finished product is pressed or deformed at a constant temperature. On the other hand, the term "forging press" preferably refers to any forming machine in which a workpiece is massively formed under an essentially linear relative movement of two tools towards and away from each other, wherein a forging method and thus also a forging press, in particular, in contrast to extrusion presses, not only a press residue remains between the tools but the ultimately used forging material.

The "pressing direction" preferably describes the direction of a die of the forging press in which a die exerts force on the semi-finished product or the direction in which a die presses on the semi-finished product. If, for example, both an upper die as well as a lower die of a forging press move against each other, there can be two opposing pressing directions. Also, depending on the specific embodiment of the forging press, pressing directions can be crooked to each other or crossed.

A "press tappet" can be understood, in particular, as the element that transfers the pressing forces to a die.

In addition, the forging press includes an upper die and a lower die. The dies are the elements of the forging press, which are pressed together during the pressing method or even brought into contact with each other, wherein only the pressed semi-finished product is arranged between the two press temples.

In the present context, an "upper die" can preferably be understood as the die which is located above the semi-finished product. On the other hand, the "lower die" can be understood as the die placed below the semi-finished product. Depending on the specific implementation, the upper die can be movable during the forging method, or the lower die. It is also conceivable that both dies are moved. Forging presses are also conceivable, which are situated in such a way that it is ultimately a pure question of definition, which of the dies is referred to as upper and which as lower die, Each of the two stamps also has in particular a cold die part and a hot die part. In the present context, the "hot die part" can preferably be understood as the part of the die which is arranged on the side of the die facing the semi-finished product, while the cold die part is arranged on the side facing away from the semi-finished product. The name comes from the fact that the hot die part is arranged directly on the tool or is arranged closer to the semi-finished product than the cold die part. The cold die part is thus further away from the semi-finished product than the hot die part. Since relatively high temperatures prevail in the forming area or pressing area, the part of the die that is located closer to the forming area is naturally also hotter than the part of the die that is further away from the forming area. In addition, the temperature difference between cold die part and the hot die part is achieved by the fact that an insulating layer is arranged between the two die parts and thus isolates the cold die part from the high temperatures.

The sides of the two die parts which are in contact with the insulating layer arranged between these two die parts are referred to in the present context as cover sides.

Under an "insulating die plate" can be understood in the present context preferably a unit comprising two parallel to each other arranged end plates and an insulating layer arranged in between and is particularly suitable and intended to be arranged between a hot and cold die part of a die and to act there insulating and transmitting forces. The end plates preferably describe rigid bodies forming the top side and bottom side of the die plate.

An "insulating layer" in the present context can preferably be understood as a layer or a layer which has a thermally insulating effect, wherein this layer can be arranged between bodies in such a way that the insulating layer isolates the bodies from each other and thus transfers as little heat as possible from one body to the other body. Simultaneously, the insulating layer can be understood as a layer that, in addition to thermal insulation, also transmits forces, particularly pressing forces. The insulating layer may also comprise ceramic insulating bodies.

An "insulating body plane" can be understood in the present context as a theoretical plane which is arranged parallel to the end plates, and which serves to describe the arrangement of the insulating bodies. Preferably, the insulating bodies are arranged on this insulating body plane in such a way that the insulating body plane also describes an arrangement of the insulating bodies at the same height.

The intermediate spaces describe that, although a plurality of insulating bodies is arranged on an insulating body plane, these preferably do not come into contact with each other so that there are free spaces on an insulating body plane between insulating bodies situated on this insulating body plane.

Thus, a total area is also created in the insulating layer, which includes both surface portions of the insulating bodies as well as surface portions of the intermediate spaces, the ratio then describes how densely the insulating bodies are arranged in the insulating body plane to each other or how many insulating bodies and how many intermediate spaces are present.

A surface portion of the insulating bodies in the total area of the insulating layer of at least 50% is, as already indicated above, also favorable since the acting forces or pressing forces are distributed over a larger area on the insulating bodies. The insulating bodies must be able to transmit or absorb the entire pressing forces and thus also withstand them. The larger the surface portion of the insulating bodies in the total area of the insulating layer, the less pressure a single of the insulating bodies has to withstand during the forging method. Thus, such an embodiment has the particular advantage that the longest possible service life of the insulating bodies can be achieved.

It is to be understood that ceramic insulating bodies are also subject to a certain expansion at high temperatures so that the insulating bodies of the present forging press are also expanded at very high temperatures. For this reason, it is favorable to use a plurality of insulating bodies instead of a single large insulating body for the insulating layer. In addition, the surface portion of the insulating bodies in the total area of the insulating layer should not be exactly 100% since there is no space left between the individual insulating bodies for the thermal expansion of the insulating bodies. Consequently, the insulating bodies could otherwise be destroyed under the influence of high temperatures.

Cumulatively or alternatively, a forging press for pressing a semi-finished product in a pressing direction comprising a press tappet and comprising at least one drawbar and comprising at least one upper die and a lower die, wherein each of the dies comprises a cold die part and a hot die part, wherein each of the dies comprises an insulating layer arranged perpendicular to the pressing direction, wherein the insulating layer is respectively arranged between the cold die part and the hot die part, wherein each of the insulating layers is arranged between a cold cover side situated on the side of the cold die part and a hot cover side situated on the side of the hot die part, wherein the insulating layer comprises ceramic insulating bodies, wherein an insulating body plane arranged at least parallel to the end plates is defined for the insulating layer, wherein the insulating bodies are arranged spaced apart next to one another on the insulating body plane, whereby, on the insulating body plane between insulating bodies, intermediate spaces are formed, wherein a total area of the insulating layer comprises at least surface portions of the insulating bodies and surface portions of the intermediate spaces, can be characterized in that, on each insulating body plane, a plurality of insulating bodies are arranged, wherein the insulating bodies have an angular basic shape in order to provide the most effective insulation with the most effective force or pressure transmission.

Cumulatively or alternatively, in order to achieve the most effective insulation with the most effective force or pressure transmission, an insulating die plate comprising two end plates arranged parallel to each other and comprising an insulating layer arranged between the two end plates, which comprises ceramic insulating bodies, wherein an insulating body plane arranged at least parallel to the end plates is defined for the insulating layer, wherein the insulating bodies are arranged next to one another spaced apart on the insulating body plane, whereby, on the insulating body plane between the insulating bodies, intermediate spaces are formed, wherein a total area of the insulating layer comprises at least surface portions of the insulating bodies and surface portions of the intermediate spaces, can be characterized in that the insulating bodies have an angular basic shape.

In the present context, an "angular basic shape" can preferably be understood as a shape that deviates from, for example, round or elliptical basic shapes. Angular basic shapes can be favorable if an arrangement of the insulating bodies on the insulating body plane is desired, for example, with a equal distance to one another, i.e., with intermediate spaces of equal size across the entire insulating body plane. Also, the embodiment of the insulating bodies with an angular basic shape is more flexible with regard to different arrangements of the insulating bodies on an insulating body plane.

Here, it is to be understood that the angular basic shape is preferably important on the insulating body plane since here, their advantages accordingly come into effect. In sections perpendicular to this insulating body plane, other considerations can be important.

Here, the angular basic shape allows a close arrangement of the insulating bodies to each other in a suitable embodiment, which is favorable with regard to the service life of the assemblies involved, in particular the insulating bodies since the forces can then be distributed as uniformly as possible on the insulating bodies.

A forging press for pressing a semi-finished product in one pressing direction comprising a press tappet and at least one drawbar and comprising at least one upper die and a lower die, wherein each of the dies comprises a cold die part and a hot die part, wherein each of the dies comprises an insulating layer arranged perpendicular to the pressing direction, wherein the insulating layer is respectively arranged between the cold die part and the hot die part, wherein each of the insulating layers is arranged between a cold cover side arranged on the side of the cold die part and a hot cover side arranged on the side of the hot die part, wherein the insulating layer comprises ceramic insulating bodies, wherein an insulating body plane arranged at least parallel to the end plates is defined for the insulating layer, wherein the insulating bodies are arranged next to one another spaced on the insulating body plane, whereby, on the insulating body plane between the insulating bodies, intermediate spaces are formed, wherein a total area of the insulating layer comprises at least surface portions of the insulating bodies and surface portions of the intermediate spaces, can be cumulatively or alternatively characterized in that the insulating bodies are anisotropically shaped in order to provide the most effective insulation with the most effective force or pressure transmission.

An insulating die plate having two end plates arranged parallel to each other and having an insulating layer arranged between the two end plates, comprising ceramic insulating bodies, wherein an insulating body plane arranged at least parallel to the end plates is defined for the insulating layer, wherein the insulating bodies are arranged next to one another spaced on the insulating body plane, whereby, on the insulating body plane between the insulating bodies, intermediate spaces between the insulating bodies are formed, wherein a total area of the insulating layer comprises at least surface portions of the insulating bodies and surface portions of the intermediate spaces, can be accordingly characterized cumulatively or alternatively in that the insulating bodies are anisotropically shaped in order to provide the most effective insulation with the most effective force or pressure transmission.

Here, the anisotropic formation can help to avoid radial preliminary stresses of the insulating bodies, which are undesirable. Since the insulating bodies are under particularly high pressure in order to be able to transmit the forces, possible radial preliminary stresses represent additional stress levels on the insulating bodies and the required or desired strength can then no longer be given. If the insulating bodies are placed under a certain radial bias, they could be destroyed much faster. With suitable embodiment, this design of the insulating bodies allows that they do not have to be preliminarily stressed radially in order to remain stable even at high pressing forces.

Especially in the case of isothermal pressing, there can be a temperature difference of at least 500 K between the cold cover side and the hot cover side. If there is a correspondingly high temperature difference between the cold cover side and the hot cover side, the insulating layer insulates sufficiently well between the two die parts, which on the one hand enables the high temperatures that should be present for an isothermal pressing method on the semi-finished product or on the workpiece, and on the other hand thermally relieves the cold die parts and the remaining assemblies accordingly.

The "cold cover side" describes in the present context the cover side of the cold die part and under the "hot cover side" can be understood in the present context preferably the cover side of the hot die part, each of which are in contact with the insulating layer.

A particularly high temperature difference is favorable here so that the insulating layer must or can insulate accordingly. During pressing, very high temperatures prevail in the area of the semi-finished product, which also ensure a correspondingly high temperature on the hot cover side due to the good thermal conductivity of the metallic material of the hot die part. Such a high temperature difference between the hot and cold cover side, such as at least 500 K for example, is only possible if the insulating layer is correspondingly well insulated.

Preferably, there is a temperature difference of at least 550 K between the cold cover side and the hot cover side. It is particularly favorable if there is a temperature difference of at least 600 K between the cold and the hot cover side in order to achieve the corresponding advantages.

Preferably, temperatures of at least 800° C. are at the hot die part. Depending on the specific circumstances, the materials processed by forging presses during forging suggest such high temperatures since, only at such high temperatures under given circumstances, do the desired effects occur in the crystal structure of the material. Thus, the high temperatures required by the forged materials to achieve their desired material properties after forming or forging are used. In order to achieve the corresponding advantages, temperatures of at least 900° C. can be applied to the hot die part. It is particularly favorable if temperatures of at least 1000° C. are applied to the hot die part.

In particular, the forging press can be an isothermal forging press since particularly high temperatures prevail in isothermal forging presses, wherein, having been explained and taken advantage of in the present case, accordingly, the insulating layer can be used particularly favorable.

Cumulatively or alternatively, in order to provide the most effective insulation with the most effective force or pressure transmission, an insulating die plate comprising two end plates arranged parallel to each other and comprising an insulating layer arranged between the two end plates, which comprises ceramic insulating bodies, wherein an insulating body plane at least parallel to the end plates is defined for the insulating layer, wherein the insulating bodies are arranged next to one another spaced apart on the insulating body plane, whereby, on the insulating body plane between the insulating bodies, intermediate spaces are formed, wherein a total area of the insulating layer comprises at least surface portions of the insulating bodies and surface portions of the intermediate spaces, can be characterized in that the insulating bodies are symmetrically formed, wherein the top side of the insulating body is equal to the bottom side of the insulating body and that all insulating bodies are plate-shaped, wherein the plates have a height and a maximum width and are designed to be wider than their height.

In order to provide the most effective insulation with the most effective force or pressure transmission, a ceramic insulating body for insulating within a die of a forging press can accordingly also be characterized in that the insulating body has a plate shape, wherein the plate has a height and a maximum width and is designed to be wider than its height.

In the present context, a "ceramic insulating body" can be understood as a body made of a ceramic, in particular, a technical ceramic. The technical ceramic preferably consists of non-metallic, inorganic materials. Technical ceramics differ from conventional ceramics in their precise processing. For example, only a certain grain size is suitable for shaping. In most cases, the ceramic powder is produced synthetically, as the naturally occurring raw materials do not meet the requirements for chemical purity or homogeneity.

Cumulatively or alternatively, in order to provide the most effective insulation with the most effective force or pressure transmission, a ceramic insulating body for insulating within a die of a forging press can be accordingly characterized in that the insulating body is symmetrically formed, wherein the top side of the insulating body is equal to the bottom side of the insulating body.

In this respect, a forging press for pressing press a semi-finished product in a pressing direction comprising a press tappet and at least one drawbar and comprising at least one upper die and a lower die, wherein each of the dies comprises a cold die part and a hot die part, wherein each of the dies comprises an insulating layer arranged perpendicular to the pressing direction, wherein the insulating layer is respectively arranged between the cold die part and the hot die part, wherein each of the insulating layers is arranged between a cold cover side arranged on the side of the cold die part and a hot cover side arranged on the side of the hot die part, wherein the insulating layer comprises ceramic insulating bodies, wherein an insulating body plane arranged at least parallel to the end plates is defined for the insulating layer, wherein the insulating bodies are arranged next to one another spaced apart on the insulating body plane, whereby, on the insulating body plane between the insulating bodies, intermediate spaces are formed, wherein a total area of the insulating layer comprises at least surface portions of the insulating bodies and surface portions of the intermediate spaces, which is characterized in that the insulating bodies are symmetrically formed, wherein the top side of the insulating body is equal to the bottom side of the insulating body, and that all insulating bodies are plate-shaped, wherein the plates have a height and a have maximum width and are designed to be wider than their height cumulative or alternatively makes the most effective insulation with the most effective force or pressure transmission possible.

In a suitable embodiment of the insulating bodies, their shape allows, in particular, for them to be produced in a relatively simple manner. Also, in the case of a suitable embodiment, this shape of the insulating bodies can ensure optimal power transmission by means of the insulating bodies since, in the case of these, the risk of force peaks or other irregularities in the force distribution can be minimized. In particular, in the case of a suitable embodiment of the insulating bodies, the highest possible surface for power transmission, flexible arrangement options for adapting to different circumstances and/or the possibility of a regular or uniform arrangement of the insulating bodies with correspondingly uniform force distribution remain.

In this case, the symmetry in the present context allows a uniform force distribution over the respective insulating body in particular.

Here, a mirror-symmetrical embodiment may preferably be present, wherein the mirror-symmetry should be present along a plane arranged parallel to the top side and bottom side at an equal distance to the top side and to the bottom side. However, it is also conceivable that there is a rotationally symmetrical symmetry around a central axis of the insulating body arranged perpendicular to the top side and bottom side. The equality of the top side and the bottom side of the insulating body may preferably be expressed in the area of the two sides. Cumulatively or alternatively, the equality of the top side and the bottom side can preferably also be understood as the geometric dimensioning of the two sides. In particular, this geometric embodiment enables a uniform force distribution in the respective insulating body, which protects it from excessive local stress peaks even under high mechanical stress in such a way that, in particular, relatively brittle ceramics can also be used at high levels of force.

In the present context, "plate" can preferably be understood as a flat piece of a hard material, for example, particularly a ceramic, which exhibits the same thickness everywhere, thereby limited on two opposite sides of a flat surface extended in relation to the thickness. The feature that the plate is wider than its height therefore describes a characteristic feature of the plate in the present context.

For example, while a circular plate may have the same width everywhere due to the circular formation, for example, a rectangular plate has different widths, wherein, in this case, the diagonal represents the maximum width and the width of one of the four sides of the rectangular basic shape of the body correspondingly describes the smallest width of the plate. Thus, the plates in the present case have in particular a maximum width, which is the same everywhere in round plates.

It is particularly favorable that plate-like embodiments can usually be produced relatively easily and are therefore also relatively inexpensive. Since the ceramic insulating bodies can be wear parts and may have to be replaced after some time where applicable, and since a plurality of insulating bodies are used for an insulating layer in a specific implementation, a correspondingly cost-effective production of the same is favorable.

In addition, the plates offer optimal power transmission, as the force between the hot die part and the cold die part can be optimally transmitted via the symmetry and the same tops sides and bottom sides. Furthermore, the above-mentioned embodiment allows the largest possible area to be used for power transmission. The larger the area of the insulating bodies and, in particular, the total area of the insulating bodies for power transmission between the two die parts, the lower the stress level on the individual insulating bodies is and thus also, the longer the service life of an insulating body. If an insulating body distributes the forces over the largest possible area, it can also reliably withstand significantly higher forces for power transmission.

In addition, the symmetrical embodiment as a plate offers flexible arrangement options of the individual insulating bodies on the insulating body plane. For example, a regular or uniform arrangement of the insulating bodies, i.e., the plates, could be carried out in the simplest possible way, whereby, consequently, also a uniform distribution of the transmitting forces between the two die parts can take place. Thereby, all insulating bodies can be substantially stressed in the same manner, and it can be prevented, for example, that individual insulating bodies experience a higher level of stress and can no longer withstand the corresponding pressure, thereby possibly being destroyed.

Preferably, the end plates are subjected to preliminary stress. In addition to the insulation itself, power transmission plays a particularly important role. However, since ceramic insulating bodies are used, a similar stress-bearing capacity as with corresponding metallic materials may not be achieved. In order to avoid additional levels of stress on the insulating bodies, the end plates can be subjected to preliminary stress. The end plates preferably form the top side and bottom side of the entire die plate formed as a unit. These can be subjected to preliminary stress in such a way that forces acting in line with the preliminary stress act on the end plate when stressed. As a result, if the pressing forces do not act, too much relief of the insulating bodies, particularly if they are formed of ceramic material, can be avoided, which would possibly lead to undesirable tensile stresses within the insulating bodies. In this way, the, in the case of a suitable embodiment, for example, the cyclic stress-bearing capacity of the die plate and the service life of the insulating bodies can be extended.

Favorably, a plurality of insulating bodies is arranged in each insulating body plane of the insulating die plate in such a way that a reliable power transmission over the insulating body and thus also the die plate can take place. Like all other metallic elements of the dies of the forging press or all elements of the forging press, the ceramic insulating bodies are also exposed to expansions due to high temperatures. A ceramic insulating body, for example, which would extend over the entire surface of the die and thus be the only very large insulating body or very large plate would transmit the forces, would also be exposed to very high levels of internal stress due to the thermally induced expansion. Due to the high temperatures as well as the high level of stress, a single large insulating body could possibly not withstand the requirements and be destroyed during operation. Since the individual small insulating bodies are subject to much lower expansions or internal levels of stress, it is favorable if a plurality of insulating bodies are arranged on the insulating body plane. Thus, each individual insulating body experiences only a small thermal expansion or stress caused by internal stress levels so that the plurality of insulating bodies can withstand the requirements for power transmission at high temperatures.

It is to be understood that the plurality of insulating bodies can be arranged apart from each other on the insulating body plane in such a way that each individual insulating body has the intermediate space required for thermal expansion.

It is favorable if ceramic insulating bodies are arranged in the insulating layer on at least two insulating body planes. In this way, the heat transfer within the tools can be influenced, in particular, the heat transfer between the two die parts of the upper die or the lower die. Thus, a much better insulating effect can be achieved since the insulating layer can be stronger and with more insulating material. In particular, internal stresses can be reduced to a minimum since the material thickness of individual insulating bodies does not have to be so great. Overall, a stronger insulating layer can be provided in such a way that the adjacent walls of the die parts can be spaced apart from each other at very different temperatures.

The arrangement in two insulating body planes means that insulating bodies of one insulating body plane are arranged above or below the insulating body in a second insulating body plane. In such an arrangement, the ceramic insulating bodies of one insulating body plane and the other insulating body plane may come into contact with each other or transfer corresponding pressing forces across their surface. It is conceivable that the insulating bodies consisting of different insulating body planes are in direct contact with each other. However, the insulating bodies made of different insulating body planes could be in contact with each other via any additional spacers and thus not be in direct contact with one another.

Preferably, in order to achieve the above-mentioned advantages in particular, ceramic insulating bodies are arranged in the insulating layer in at least three insulating body planes, wherein the corresponding insulating effect at acceptable strength of the insulating body is further enhanced and the insulating layer is further developed.

Preferably, the insulating bodies of the individual planes are arranged coaxially to each other. The coaxial arrangement ensures a reliable hold of the plates when subjected to stress since the insulating bodies of the individual planes are subjected to stress across their entire top side or bottom side against the insulating bodies of the other plane. In addition, this ensures an even distribution of force since all insulating bodies of the individual planes distribute the forces to be transmitted over the largest possible area. Also in order to prevent edge breaks of the plates, a coaxial arrangement of the insulating bodies of the individual planes to each other may be favorable. This particularly applies if the respective insulating bodies are the identically designed. Overall, the pressing surface can be maximized in this way, which leads to a safer transmission of power across the insulating bodies, as there is less risk of them being damaged during pressing.

It is to be understood that a different than a coaxial arrangement of the insulating bodies of the individual planes to each other can be used if these bring advantages for the corresponding embodiment.

In the present context, the coaxial orientation to each other can preferably be understood as the arrangement of two insulating bodies of the individual planes which are arranged coaxially to each other on a common central axis. Each insulating body has its own central axis, preferably perpendicular to an insulating body plane. In a coaxial arrangement, the two central axes of the insulating bodies of the individual planes are the same so that the insulating bodies, possibly apart from an angular offset, each have corresponding central axes. In particular, the respective insulating bodies may optionally be aligned at an identical angle with respect to the central axis. Put simply, this could also be understood to mean that preferably the insulating bodies of the individual planes are arranged as precisely as possible on top side of each other.

Preferably, the insulating bodies are aligned identically so that the insulating bodies are arranged both coaxially on top side of each other in addition to having the same orientation. The same orientation is reflected, in particular, in an angular embodiment of the insulating bodies. Then the corners and edges of the coaxially arranged insulating bodies are aligned exactly the same and lie on top side of each other accordingly. For example, the orientation is not relevant for circular insulating bodies since it makes no difference how circular and coaxially arranged insulating bodies are ultimately aligned. In angular embodiments of the insulating bodies, such as, for example, also in the case of a triangular or hexagonal embodiment, there can be an arrangement of the insulating bodies on an edge-by-edge or corner-by-corner basis in this way. This ensures a reliable hold of the plates or insulating bodies when subjected to stress, as well as an even distribution of force. Above all, edge breaks of the plates can be avoided as far as possible in this way since otherwise, edges or corners of an insulating body could project over the edges of another insulating body and then increased forces could arise in the area of the corners and edges that project over the edges of the other insulating body in such a way that edges could possibly break off when subjected to stress.

It is favorable if an intermediate layer is arranged between the insulating bodies arranged on top side of each other, which, if only due to the material transfer, may have an additional insulating effect so that the overall insulating effect of the insulating layer can be improved. In particular, in an arrangement of the insulating bodies coaxially to each other, it can be that due to the intermediate spaces between the individual insulating bodies within an insulating body plane, the hot cover side sees the cold cover side, which means that there is an obstacle-free path from the hot cover side to the cold cover side. In this case, heat transfer between the two die parts would also be possible via the air due to radiation. Due to the intermediate layer, particularly if this is designed to be continuous, it is not possible for the hot cover side to "see" the cold cover side so that a lower heat transfer from the hot to the cold cover side can take place. In addition, the intermediate layer can also contribute to a reliable stacking of the plates on top side of each other. In particular, the intermediate layer can serve here as a positioning means so that the insulating bodies of one insulating body plane can be placed in the simplest possible manner and accurately in relation to the insulating bodies of the second insulating body plane. In addition, a particularly good force distribution and high pressing surface within the insulating layer can be realized across the insulating bodies since the forces can be distributed even better via the intermediate layer.

In the present context, the "intermediate layer" can preferably be understood as a very narrow plate-like embodiment made of any suitable material, such as a ceramic material, mylar or a similar material for example, which can be very flat but large and also has good insulating properties and the can simultaneously withstand or transmit the high levels of force.

Favorably, the insulating layer comprises positioning means for positioning the insulating bodies. The positioning means allow the insulating bodies to be held in position to prevent unwanted offset or unintentional slipping of the plates or insulating bodies. In particular, it can thus be ensured by the positioning means in a suitable embodiment that the insulating bodies are held both outside as well as when subjected to stress during forging in a coaxial arrangement to each other or in a similarly aligned arrangement. Furthermore, the intermediate spaces between the insulating bodies within an insulating body plane can be kept equal so that the distances between the insulating bodies can be kept as constant as possible. Thus, the positioning means can also contribute to an even distribution of force within the insulating layer.

The insulating bodies naturally expand at the high temperatures. This expansion of the plates takes place in particular in the intermediate spaces between the insulating bodies of an insulating body plane, insofar as corresponding intermediate spaces are provided. For this reason, it is favorable if, on the one hand, the intermediate spaces between the plates necessary for expansion can be maintained constantly and safely. On the other hand, it is favorable if these intermediate spaces are only kept as large as necessary in order to achieve the greatest possible distribution of forces and the largest possible pressing surface. For this purpose, the positioning means can be particularly favorable since, for example, it can be determined beforehand how large the expansion of the insulating body will be maximum and on the basis of this knowledge, the necessary size of the intermediate spaces can be determined. This size can preferably then be adjusted and held by the positioning means. The theoretically optimal technical case would be that, in the stressed state, at the maximum thermal expansion of the insulating bodies under the given concrete circumstances, the distances between the insulating bodies within an insulating body plane converge to zero since then, the maximum pressing surface or the greatest possible force distribution in the insulating layer between the insulating bodies is generated without the insulating bodies pressing against each other or exerting pressure on each other.

It is conceivable that positioning means, for example, rod-like or pin-like are designed and/or are firmly mounted on the hot or on the cold cover side. The positioning means then engage, for example, in an opening within the insulating bodies in such a way that, in this way, the insulating bodies are held in position. It is to be understood that numerous embodiments of positioning means come into question here, which can in any way hold the insulating bodies in their position. For example, the above-mentioned positioning means can be formed so long that they protrude through the openings of a plurality of insulating bodies and thus hold a plurality of insulating bodies simultaneously in their position. In this way, the positioning means can, for example, the position of the insulating bodies by a positive-locking fit. However, a positive-locking fit could, for example, also be designed in such a way that no complete opening through the plates is necessary, but an insulating body can only be held, for example, via a tongue-groove-connection between the insulating body and one of the two cover sides or between the insulating body and an intermediate layer. It is to be understood that in the one-sided arrangement of a groove or tongue on the insulating body, the symmetry between the top side and bottom side of the insulating body may no longer be 100%, but even then, the two sides are to be understood as symmetrical according to the present definition. The arrangement of a corresponding positioning means does not exclude a symmetry of the insulating bodies according to the present definition.

It is favorable if the positioning means are formed as spacers, which can be provided, for example, for arrangement in the intermediate spaces between the insulating bodies in order to maintain the distances between the plates or to keep the same. Then an even distribution of forces can take place over the insulating bodies. In addition, the positioning means can provide a safeguard against unwanted offset or against unwanted slipping of the insulating bodies. Here, the spacers can be formed in a variety of ways, wherein these preferably hold the distances between the plates via a positive-locking fit.

Due to the thermal expansion of the insulating bodies during operation, it is to be understood that the spacers are preferably designed in such a way that they do not completely stand in the way of the thermal expansion of the insulating bodies. For this reason, it is favorable if the spacers are arranged only in the edge area between the insulating bodies and thus, for example, only over a very small area laterally of the insulating body plates are arranged in such a way that the insulating bodies can still expand across the largest area into the intermediate spaces. It is also conceivable that the spacers are formed of a material which has sufficient strength to keep the insulating bodies in their position or at a distance but yields to a thermal expansion of the insulating body and thereby, it does not significantly stand in the way of the thermal expansion of the insulating bodies and also does not ensure that the pressure arising from the thermal expansion of the insulating bodies are transmitted onto the adjacent insulating bodies via the spacers.

In addition, the insulating body can also be designed in such a way that the thermal conductivity of the insulating body is a maximum of 10 W/mK since a low thermal conductivity requires a correspondingly good insulation.

Furthermore, cumulatively or alternatively, a ceramic insulating body for insulating in a die of a forging press can also be characterized in that the insulating body has an open porosity of zero vol % in order to provide the most effective insulation with the most effective force or pressure transmission.

In the present context, "open porosity" can be understood as porosity, which describes those pore spaces in which liquids and gases are involved in exchange processes. Accordingly, an open porosity of zero vol % provides a gas-tight formation of the insulating body so that the insulating body has a particularly good insulating effect and can still transmit high pressing forces.

Cumulatively or alternatively, in order to provide the most effective insulation with the most effective force or pressure transmission, a ceramic insulating body for insulating in a die of a forging press can be characterized by the fact that the insulating body has a density between 2.2 and 5.0 $cm^3$. In the search for a suitable material for the insulating bodies, it has been shown that insulating bodies with a density between 2.2 and 5.0 $cm^3$ have the desired properties, in particular, sufficient pressure transmission and insulation capacity, and the appropriate material composition provides for the density.

It is favorable if the insulating body has a density between 2.5 and 4.0 $g/cm^3$. This density is due to the material composition, which, as has been shown, brings the desired favorable material properties for the insulating body with it.

A ceramic insulating body for insulating in a die of a forging press can be characterized cumulatively or alternatively in that the insulating body has a flexural strength in the unglazed state between 100 and 450 MPa in order to provide the most effective insulation with the most effective force or pressure transmission. The ceramic insulating body then preferably has sufficient flexural strength to withstand stress levels during the forging method.

It is also favorable if the insulating body has a flexural strength in the unglazed state between 110 and 300 MPa.

Cumulatively or alternatively, in order to provide the most effective insulation with the most effective force or pressure transmission, a ceramic insulating body for insulating in a die of a forging press can be characterized in that the insulating body has a modulus of elasticity between 70 and 200 GPa. It has been shown that an insulating body made of a material with a corresponding modulus of elasticity can bring the desired properties required for the insulating body.

In a particularly favorable embodiment, the insulating body has a modulus of elasticity between 75 and 160 GPa.

Cumulatively or alternatively, a ceramic insulating body for insulating in a die of a forging press in order to provide the most effective insulation with the most effective force or pressure transmission, can be characterized in that the insulating body has an average coefficient of linear expansion at 300 to 600° C. between 5 and $10^{-6}$ $K^{-1}$. Such an average coefficient of linear expansion has proven to be particularly favorable for the material of the insulating body to fulfil the required object in a forging press, in particular in an isothermal forging press.

It is favorable if the insulating body has an average coefficient of linear expansion at 30 to 600° C. between 6 and 9 $10^{-6}$ $K^{-1}$ to provide the desired properties for the insulating bodies.

In order to provide the most effective insulation with the most effective force or pressure transmission, cumulative or alternatively a ceramic insulating body for insulating in a die in a forging press can be characterized in that the insulating body has a specific heat capacity at 300 to 600° C. between 700 and 1000 $Jkg^{-1}K^{-1}$. It has been shown that insulating media made of a material with a corresponding specific heat capacity provides the desired insulating properties during an ongoing forging method while simultaneously providing sufficient compressive strength.

Cumulative or alternatively for particularly suitable insulating properties of the insulating body may have a specific heat capacity at 30 to 600° C. between 750 and 970 $Jkg^{-1}K^{-1}$.

Cumulatively or alternatively, a ceramic insulating body for insulating in a die in a forging press can be characterized in that the insulating body has a thermal conductivity between 1.5 and 5 $Wm^{-1}K^{-1}$. For use as an insulating body in a forging press at high temperatures, an insulation body with a corresponding thermal conductivity has proven to be particularly suitable to bring the desired favorable properties. In particular, the thermal conductivity should be as low as possible since the insulating body should insulate and the heat should not be transferred well.

Also, the insulating body may preferably have cumulative or alternatively a thermal conductivity between 1.7 and 4.5 $Wm^{-1}K^{-1}$. For use as an insulating body in a forging press at high temperatures, the above-mentioned value ranges have proven to be particularly favorable.

In order to provide the most effective insulation with the most effective force or pressure transmission, cumulative or alternatively a ceramic insulating body for insulating in a die of a forging press can be characterized in that the insulating body at 20° C. has a specific electrical resistance between $5 \cdot 10^{10}$ and $10^{12}$ Ohm·cm. Admittedly, a temperature of 20° C. does not correspond to the high temperatures of forging, especially isothermal forging; on the other hand, this material constant can already make a good statement about the thermally conductive properties of the material as a whole since usually, the changes over the temperature of ceramics themselves are quite well known. In order to provide the most effective insulation with the most effective force or pressure transmission, cumulatively or alternatively, the ceramic insulating body for insulating in a die of a forging press can be characterized in that the insulating body at 600° C. has a specific electrical resistance between $5 \cdot 10^2$ and $10^6$ Ohm·cm. A correspondingly high resistor ensures that the thermally insulating properties of the insulating body improve since the conduction of electricity also conducts heat, which is just undesirable for the present use as an insulating body so that the insulating properties of the insulating body can thus be further improved.

Preferably, the insulating body has a specific resistance between $8 \cdot 10^{10}$ and $5 \cdot 10^{11}$ Ohm·cm at 20° C. Cumulatively or alternatively, the insulating body in a particularly favorable embodiment at 600° C. has a specific resistance between $7 \cdot 10^2$ and $9 \cdot 10^5$ Ohm·cm.

Cumulatively or alternatively, a ceramic insulating body for insulating in a die of a forging press in order to enable the most effective insulation with the most effective force or pressure transmission, is characterized in that the insulating body has a proportion of soapstone between 50% and 95%.

In the present context, soapstone can preferably be understood as a naturally occurring, massive or shale chemical substance, which, depending on its composition, is considered a mineral or a rock. Its main ingredient is talc; it makes soapstone a mineral in its pure form. In the present context, soapstone represents an essential component of the material from which the insulating body can be formed. Ceramics with a corresponding proportion of soapstone can be characterized in particular by a good dimensional retention and good insulation properties with a suitable choice of components and composition.

It is favorable if the insulating body has a proportion of soapstone between 60% and 92%.

Cumulatively or alternatively, a ceramic insulating body for insulating in a die of a forging press can be characterized in that the insulating body has a proportion of 50% to 85% $SiO_2$. A corresponding proportion has proven to be correspondingly favorable for the required properties to the material of the insulating body.

Preferably, the insulating body has cumulatively or alternatively a proportion of 55% to 75% $SiO_2$.

In order to provide the most effective insulation with the most effective force or pressure transmission, a ceramic insulating body for insulating in a die of a forging press can be characterized cumulatively or alternatively in that the insulating body has a proportion of 20% to 40% MgO. A corresponding proportion has proven to be very suitable for the formation of an insulating body with particularly favorable properties.

Cumulatively or alternatively, the insulating body has a proportion of 25% to 35% MgO.

In this case, it is to be understood that in particular the combination of the above-mentioned materials leads to correspondingly favorable ceramics to be used. Although it is conceivable that individual combinations do not represent quite optimal ceramics, wherein optimized combinations can be found by different tunings and experiments Preferably, the insulating body is anisotropically shaped to avoid radial bias, as already explained above. Under the anisotropic formation can be understood in the present context, preferably the directional dependence of a property or a method of the insulating body or the material of the insulating body.

Favorably, the insulating body has an angular basic shape, as also explained above, so that a close arrangement of the same can be made possible.

It is favorable if the insulating body has a rectangular basic shape. With a rectangular basic shape, the insulating bodies can be produced as simply as possible and thus cost-effectively, which is particularly favorable for a typical wear body. On the other hand, a rectangular basic shape allows the arrangement of insulating bodies on an insulating body plane with the smallest possible intermediate spaces in order to provide the largest possible area for power transmission. An even arrangement with evenly sized intermediate spaces between insulating bodies is also possible for an even distribution of force.

Particularly flexible arrangement options of the insulating bodies, in particular on an insulating body plane, result when the individual insulating bodies have a triangular basic shape. These also allow an arrangement with small intermediate spaces between the insulating bodies for the largest possible area for power transmission as well as equal distances between the insulating bodies for uniform force distribution. In particular, a triangular basic shape results in very flexible arrangement options.

Favorably, the insulating body has a hexagonal basic shape, which allows flexible arrangement options of the insulating body on an insulating body plane. In addition, the insulating bodies can then be arranged with small intermediate spaces to form the largest possible area for power transmission. In addition, evenly sized intermediate spaces between the insulating bodies can be realized in a particularly simple way for an even distribution of force over the insulating bodies.

Preferably, the maximum width of the insulating body is at least twice the height of the insulating body. In this way, a dimensioning in the form of plates can be achieved, in which sufficient strength can be guaranteed during pressing. In addition, the plate-like embodiment is relatively flat in this way so that a plurality of panels can be stacked within the intermediate space available for the insulating layer.

Such dimensioning is also particularly favorable with regard to thermal expansion since a plate with too wide a width could bring undesirable internal stresses during thermal expansion.

To achieve the same benefits, the maximum width of the insulating body can be at least 2.5 times the height of the insulating body.

It is particularly favorable if the maximum width of the insulating body is at least 3 times the height of the insulating body to achieve the above-mentioned advantages.

It is to be understood that the features of the solutions described above or in the claims may also be combined where applicable in order to be able to implement the advantages accordingly cumulatively.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 2:
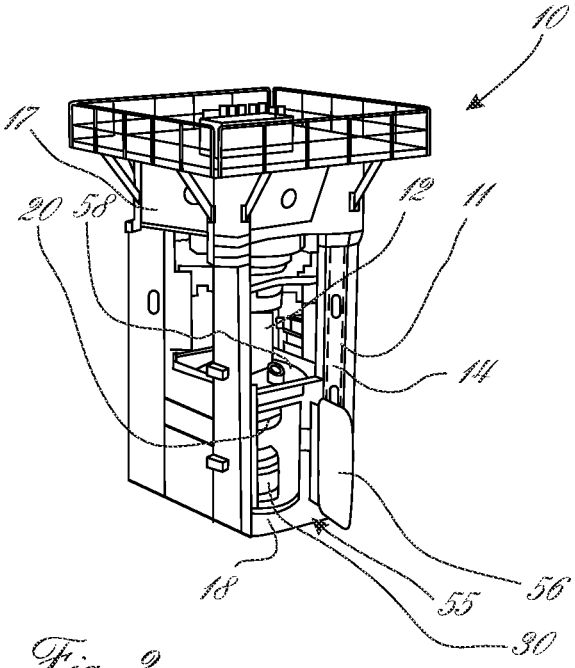
FIG. 2 shows a perspective view of an isothermal forging press comprising an upper die and a lower die

A forging press 10, as shown as an example in FIG. 2 in the form of an isothermal forging press, comprises four externally arranged columns 11 (only numbered in FIG. 2 as an example), which on the one hand carry an upper belt 17 and a lower belt 18 and on the other hand enclose tension rods 14, which in turn are attached to the upper belt 17 and to the lower belt 18, and an upper die 20 arranged between the columns 11 and a lower die 30 arranged between the columns 11. Above the upper die 20, a press tappet 12 is also arranged in this exemplary embodiment, which can apply force to the upper die 20 and is supported on the upper die 17, wherein the tension rods 14 can meet this force via the lower purge 18 and the lower die 30.

In this exemplary embodiment, the lower belt 18 is provided in the floor so that the attachment of the tension rods 14 to the lower belt takes place under floor. It is to be understood that in deviating but, in principle, also known embodiments of forging presses, for example, the tension rods 14 and the columns 11 may each be designed as a single assembly. Likewise, the press tappet 12 can also act, for example, between lower belt 18 and lower die 30. The embodiment of the die plate 1 explained below, as it is to be used in the present exemplary embodiment, can ultimately be used in almost every known type of forging press.

Figure 1:
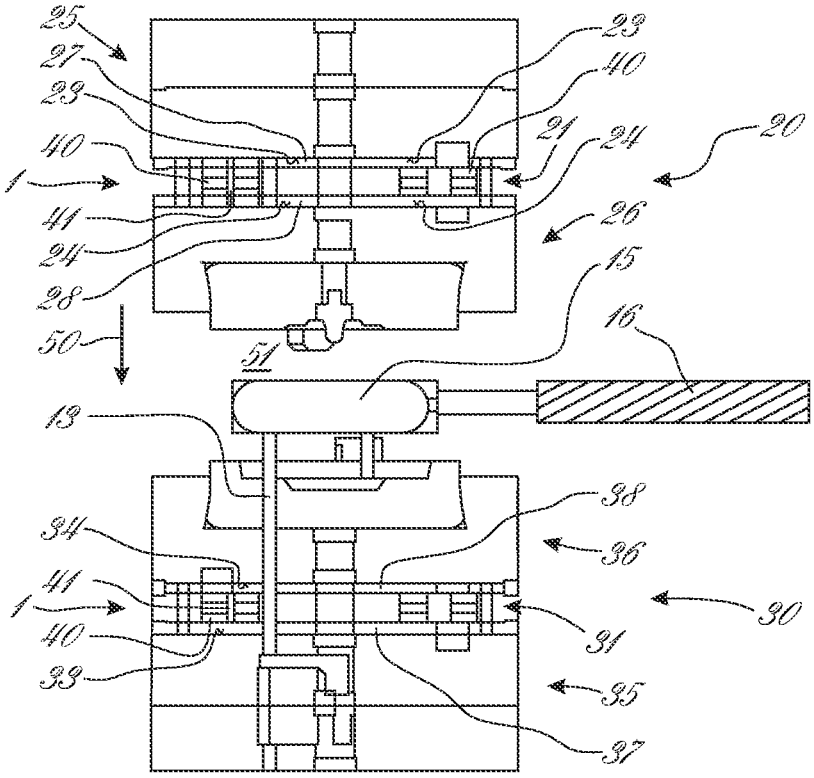
FIG. 1 shows an upper die and a lower die of a forging press, each with a die plate in schematic view.

In the present exemplary embodiment in accordance with FIG. 1, the lower die 30 remains firmly at its position during the forging method, while the upper die 20 moves in the direction of the lower die 30, which accordingly also defines the pressing direction 50.

In addition, the forging press 10 comprises a vacuum forging chamber 58 in a forming area 51 between the upper die 20 and the lower die 30 so that a corresponding workpiece can be forged in a vacuum-occupied space to avoid unwanted reactions with ambient air. The actual forging area is accessible for maintenance via a maintenance opening 55, which can be opened and closed with a maintenance door 56.

In addition, the present forging press 10 can be used as an isothermal forging press, at which relatively high temperatures prevail, which are kept the same during the forging method. Also in this context it should be emphasized again that, here too, the exact and concrete structure of the forging press 10 does not necessarily have to correspond to the present exemplary embodiment, as long as the die plate 1 described below is used.

In the present forging press 10, between the upper die 20 and the lower die 30, a semi-finished product 15 to be formed for forging is arranged in the forming area 51, which is provided between upper die 20 and lower die 30. A manipulator 16 brings the semi-finished product 15 to its position in the forming area 51 and can remove it, in turn, so that loading within the vacuum forging chamber 58 can also be carried out without manual access. Via an ejector 13, the forged semi-finished product 15 can be ejected in the simplest possible manner to facilitate access to the manipulator 16.

Via the manipulator 16, a semi-finished product 15 is moved into the forming area 51 and then the upper die 20 is pressed onto the semi-finished product 15 in the pressing direction 50. In this case, temperatures of over 800° C. respectively prevail at the hot die parts 26, 36 since the forging method in the present exemplary embodiment preferably takes place as isothermal pressing and accordingly very high temperatures are present in the forming area 51.

In order to be able to withstand the high temperatures at the upper die 20 and at the lower die 30, these must be made of correspondingly heat-resistant material. However, the high demands on the material require an extremely expensive material so that it is uneconomical to manufacture the entire upper die 20 and lower die 30 of a forging press 10 from the particularly expensive material.

In this exemplary embodiment, for this reason, the upper die 20 comprises a hot die part 26 and a cold die part 25. The hot die part 26 is arranged here towards the forming region 51, while the cold die part 25 is the die part of the upper die 20, which is arranged further away from the forming region 51. Since the highest temperatures prevail in particular in the forming area 51, higher temperatures are present at the hot die part 26 than at the cold die part 25, from which the designation of the two die parts originates.

Accordingly, the lower die 30 also comprises a hot die part 36 and a cold die part 35, wherein the hot die part 36 is also arranged towards the forming area 51 and the cold die part 35 is the part of the lower die 30 further away from the forming area 51.

In the upper die 20, a die plate 1 is provided between the cold die part 25 and the hot die part 26, which is in contact with a cold cover side 23 of the upper die 20 and with a hot cover side 24 of the upper die 20. The cold cover side 23 is the side of the cold die part 25 facing the hot die part 26. The hot cover side 24 is the side of the hot die part 26 facing the cold die part 25. Thus, the die plate 1 in the present exemplary embodiment is arranged between the hot cover side 24 and the cold cover side 23 and is in contact with them.

Accordingly, a die plate 1 is also arranged between the cold die part 35 and the hot die part 36 in the lower die 30. Also in the case of the lower die 30, the hot die part 36 comprises a hot cover side 34, which is arranged in the direction of the cold die part 35, and the cold die part 35 a cold cover side 33, which is arranged in the direction of the hot die part 36. Accordingly, the die plate 1 of the lower die 30 is also arranged between the hot cover side 34 and the cold cover side 33 and is in contact with these two sides.

The die plates 1 of the upper die 20 and the lower die 30 each comprise two end plates 27, 28, 37, 38 arranged parallel to each other. An insulating layer 21, 31 is arranged between the two end plates 27, 28, 37, 38.

In addition, the insulating layers 21, 31 each comprise ceramic insulating bodies 40, which are arranged next to one another spaced in insulating body planes 22, 32. The insulating body planes 22, 32 are defined here parallel to the end plates 27, 28, 37, 38 but not separately provided with reference numbers in the present illustration in accordance with FIG. 1. It is to be understood that—depending on the requirements—in deviating embodiments, fewer or more insulating body planes 22, 32 can be provided. In particular, an insulating body plane 22, 32 can be sufficient.

Due to the fact that the insulating bodies 40 are arranged spaced apart from each other on the insulating body plane, intermediate spaces 41 are formed between the insulating bodies 40. These allow a thermal expansion of the individual insulating bodies 40

While, in the case of the upper die 20, the die plate 1 is in contact with both the hot die part 26 as well as the cold die part 25, the end plate 27 of the die plate 1 adjacent to the cold die part 25 forms a cold end plate 27 and the end plate 38 of the die plate 1 in contact with the hot die part 26 forms a hot end plate 28.

Accordingly, in the case of the lower die 30, the end plate 38 of the die plate 1 in contact with the hot die part 36 forms a hot end plate 38 and the end plate 37 of the die plate 1 in contact with the cold die part 35 forms a cold end plate 37.

In order to provide relief to the cold die parts 25, 35, the insulating die plates 1, and, in particular, their insulating layer 21, 31 unfold an insulating effect within the upper die 20 or the lower die 30 in such a way that only the respective hot die part 26, 36 must be made of the expensive and particularly heat-resistant material. The insulating layer 21 or the die plate 1 ensures that then the cold die parts 25, 35 are each insulated in such a way that significantly lower temperatures are applied to them and these can thus be made of a more cost-effective material. Thus, the insulating die plate 1 or the insulating layer 21, 31 ensures in the present exemplary embodiment that between the cold cover sides 23, 33 and the hot cover sides 24, 34 each a temperature difference of at least 500 K can prevail.

On the one hand, the insulating body 40 should thus have a correspondingly good insulating effect in order to enable the desired insulation between hot die part 26, 36 and cold die part 35, 25. On the other hand, the insulating bodies 40 should have the required strength since high levels of force prevail in the forging method or in the pressing method, which must be transmitted via the insulating bodies 40 in such a way that the insulating bodies 40 may not be destroyed during the pressing method.

In order to be able to counter the acting forces, the insulating bodies 40 can be arranged or formed in various ways, as shown inter alia by means of FIGS. 3 to 7, wherein it is particularly favorable if the pressing surface is designed as large as possible so that a better distribution of force over the entire insulating body 40 can take place.

Figure 3:
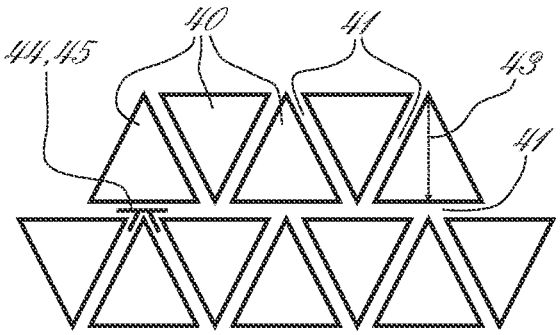
FIG. 3 shows a first arrangement of a plurality of insulating bodies in schematic view to the insulating body plane.

In a first exemplary embodiment in accordance with FIG. 3, the insulating bodies 40 are formed with a triangular basic shape, wherein each of the insulating bodies 40 has a maximum width 43.

The insulating bodies 40 are also spaced apart from each other, wherein there is an equal intermediate space 41 between the insulating bodies 40 everywhere. Even if the largest possible force distribution over the largest possible pressing surface is to be provided, intermediate spaces 41 between the insulating bodies 40 should be provided since the insulating bodies 40 also expand thermally by the heat and thus an expansion of the insulating body 40 into the intermediate spaces 41 can take place. Otherwise, there is an increased risk that the insulating bodies 40 press against the other insulating bodies 40 when expanding and exert pressure on each other, which could lead to damage to the insulating bodies 40.

Due to the triangular embodiment of the insulating bodies 40, these can be arranged very flexibly within an insulating body plane 22, 32. In addition, the triangular formation of the insulating body 40 allows that the insulating bodies 40 can be arranged in a particularly simple manner with very small intermediate spaces 41 but also with equally sized intermediate spaces 41. In addition, the production of insulating bodies 40 with a triangular basic shape is also particularly simple.

Furthermore, positioning means 44 designed as spacers 45 are arranged in the intermediate spaces 41 between the insulating bodies 40. These ensure that the insulating bodies 40 are held in their positions and are not accidentally slipped or moved. The spacers 45 maintain the desired distance between the insulating bodies so that the intermediate spaces 41 remain the same size. Because of the expansion of the insulating bodies 40 in heat, the spacer 45 is respectively designed in such a way that it is only maintains the insulating bodies 40 at a distance in the area of the outer edges. This is sufficient to maintain the corresponding distances but is just designed in such a way that the insulating bodies 40 can nevertheless thermally expand overall into the intermediate spaces 41 and are not significantly impaired by the spacer 45 during expansion. It is conceivable that spacers 45 may also be designed in such a way that they can maintain the distance between insulating bodies but give way when expanding the insulating bodies and thereby do not affect the expansion of the insulating bodies 40. Likewise, a suitable clearance between the spacers 45 and the insulating bodies 40 can also be provided.

Figure 4:
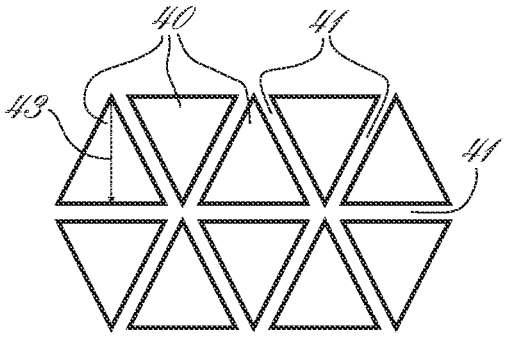
FIG. 4 shows a second arrangement of a plurality of insulating bodies in schematic view of the insulating body plane.

Since the arrangement of the insulating bodies 40 is flexible with a triangular basic shape, the insulating bodies 40 can also be arranged offset, as shown in a second exemplary embodiment in accordance with FIG. 4. Here, the insulating bodies 40 are formed as in the first exemplary embodiment in accordance with FIG. 3, but the corners of the triangular basic shape of the insulating body 40 each point to the corners of the adjacent insulating bodies 40 or the corners of adjacent insulating bodies 40 are aligned on a point. In the first exemplary embodiment in accordance with FIG. 3, however, the corners of the triangular basic shape of the insulating body each point on the side of the triangular basic shape of the insulating body 40. It is to be understood that the insulating bodies 40 can be moved or moved arbitrarily flexibly at equal-sized intermediate spaces 41.

Figure 5:
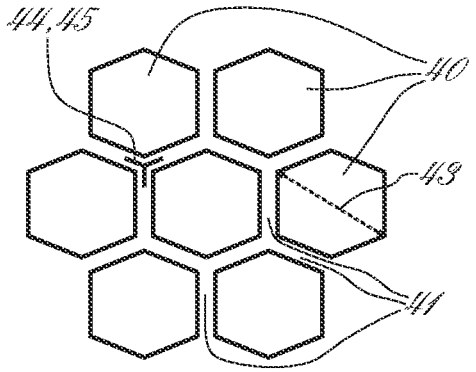
FIG. 5 shows a third arrangement of a plurality of insulating bodies in schematic view of the insulating body plane.

In a further exemplary embodiment in accordance with FIG. 5, the insulating bodies 40 with a maximum width 43 are also spaced from each other with equal-sized intermediate spaces 41, wherein spacers 45 are also engaged into the intermediate spaces between the insulating bodies 40.

However, the insulating bodies 40 are designed in the exemplary embodiment in accordance with FIG. 5 in a hexagonal basic shape, which are also easy to produce. In addition, the insulating bodies 40 with a hexagonal basic shape can be arranged relatively flexibly to each other and thereby keep the intermediate spaces 41 as small as possible but also the same size. Here it can be assumed that, in the case of such a basic shape, thermal loads under tension are lower than in a triangular basic shape since the insulating bodies 40 extend more uniformly on the insulating body plane 22, 32.

Figure 6:
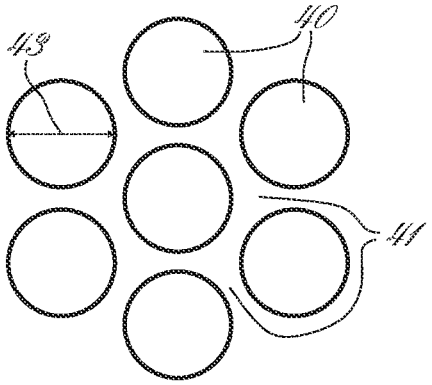
FIG. 6 shows a fourth arrangement of a plurality of insulating bodies in schematic view of the insulating body plane.

In a further exemplary embodiment in accordance with FIG. 6, it is also conceivable that the insulating bodies 40 with a maximum width 43 are designed with a circular basic shape, wherein it is technically not possible that these comprise intermediate spaces 41 of equal size everywhere. However, the insulating bodies 40 with a circular basic shape can also be easily manufactured and flexibly laid. In addition, very low thermal stresses within the insulating bodies 40 are to be expected in this basic form.

Figure 7:
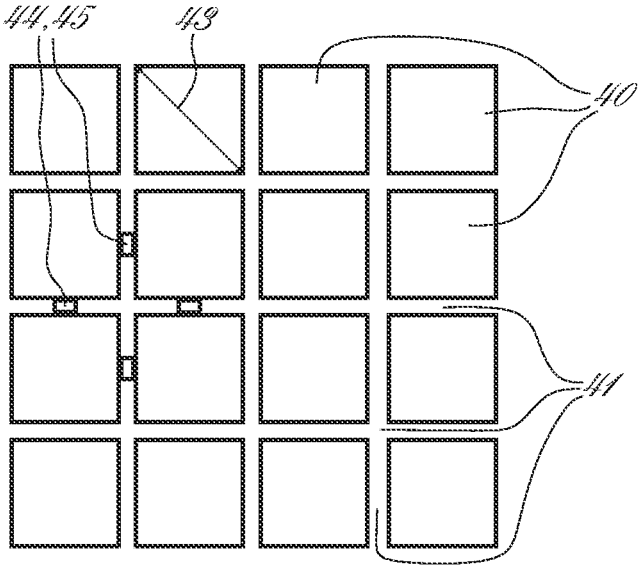
FIG. 7 shows a fifth arrangement of a plurality of insulating bodies in schematic view of the insulating body plane.

In a further exemplary embodiment in accordance with FIG. 7, the insulating bodies 40 with a maximum width 43 are designed in a square basic shape, whereby the insulating bodies 40 can be arranged as easily as possible with equal-sized intermediate spaces 41 spaced apart from each other.

In addition, spacers 45 are arranged between the individual insulating bodies 40, which, in contrast to the previous exemplary embodiments, are not arranged in the region of the outer corners or edges of the insulating bodies 40 but centrally on the sides of the insulating bodies 40. However, these are designed or dimensioned in such a way that these do not significantly impair the expansion when expanding the insulating body 40 but only ensure that the insulating bodies 40 are held in their position. Optionally, the insulating bodies 40 can counteract thermal expansion by tilting on the insulating body plane 22, 32 and reduce the intermediate spaces 41 without exerting too much force onto the spacers 45.

It is to be understood that further embodiments of the insulating body 40 and their arrangements are also possible as long as the highest possible pressing surface for the largest possible force distribution and preferably as identical intermediate spaces 41 for a good force distribution are created.

In addition, the die plate 1 can also be embodied in its cross-section in different ways, as shown for example in FIGS. 8 to 12.

Figure 8:
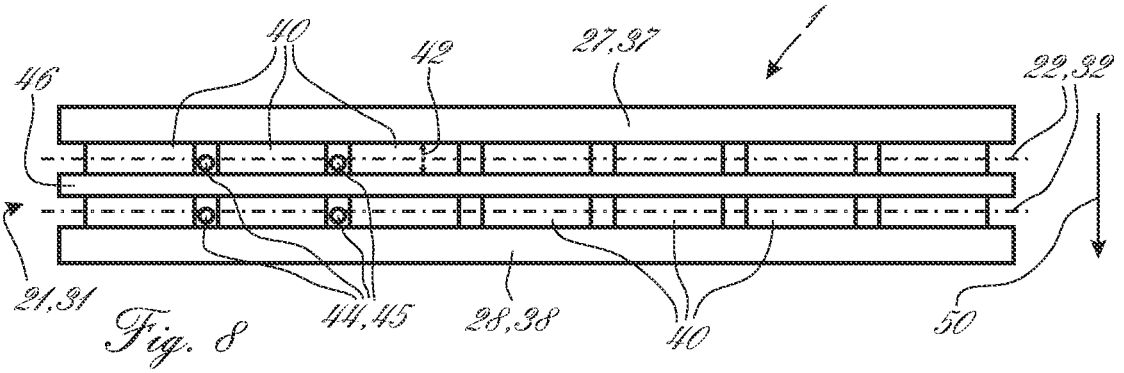
FIG. 8 shows a first die plate with intermediate layer in a schematic cross-section perpendicular to the insulating body plane.

In a first exemplary embodiment in accordance with FIG. 8, the die plate 1 comprises two parallel end plates 27, 28, 37, 38, wherein an insulating layer 21, 31 is arranged between the two end plates 27, 28, 37, 38.

In the present exemplary embodiment, the insulating layer comprises two insulating body planes 22, 32, in each of which the insulating bodies 40 are spaced apart.

The insulating bodies 40 of the first insulating body plane 22 are arranged coaxially to the insulating bodies 40 of the second insulating body plane 32 in the exemplary embodiment explained by FIG. 8.

The coaxial arrangement of the insulating bodies 40 to each other allows a particularly good force distribution and a high pressing surface so that the forces transmitted during pressing can be well distributed over the insulating bodies 40.

In addition, an intermediate layer 46 is arranged parallel to the end plates 27, 28, 37, 38 between the insulating bodies 40 of the two insulating body planes 22, 32, wherein these can be dispensed with in deviating embodiments.

The intermediate layer 46 additionally has a force-distributing effect so that the transmitted forces can be even better transmitted between the insulating bodies 40. Also, the intermediate layer 46 allows radiation protection from the respective hot end plate 28, 38 to the respective cold end plate 27, 37 through the intermediate spaces 41.

The intermediate layer 46 may, for example, be formed from mylar film or from a similar material.

In intermediate spaces 41 between the insulating bodies 40 are also arranged as positioning means 44 acting spacers 45, which maintain the distances of the insulating bodies 40 and thus provide equal intermediate spaces 41 between the insulating bodies 40. Thus, accidental slipping or displacement of the insulating body 40 can be prevented. Depending on the concrete embodiment, these positioning means 44 can also serve as radiation protection.

Depending on the concrete implementation, these spacers 45 or these positioning means can be formed as rods or brackets or continuously in the form of a net.

Figure 9:
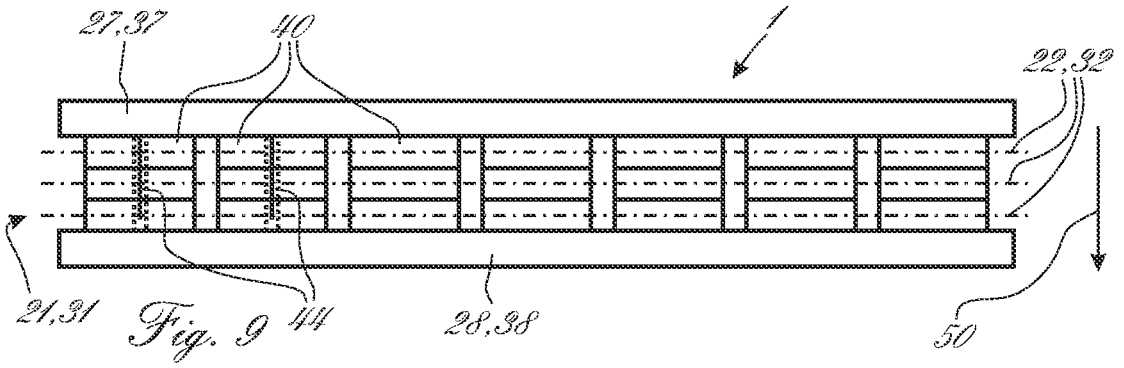
FIG. 9 shows a second die plate with positioning means in schematic cross-section perpendicular to the insulating body plane.

A second exemplary embodiment of a die plate 1, as shown in FIG. 9, differs from the first exemplary embodiment in accordance with FIG. 8 in that just no intermediate layer 46 is used and insulating bodies 40 are arranged coaxially to each other on three insulating body planes 22, 32. In addition, the insulating bodies 40 are arranged at an equal distance from each other so that intermediate spaces 41 of equal size are present between the insulating bodies 40.

In order to be able to hold the insulating bodies 40 in their position and to prevent accidental slipping or displacement of the insulating body 40, the die plate 1 comprises positioning means 44, which, in the present exemplary embodiment, are designed in such a way that a long and narrow rod-like element protrudes from the cold end plates 27, 37 perpendicular to the end plate 27, 37 and engages into openings, which are centrally located in the insulating bodies. Preferably, the positioning means 44 is arranged on the cold end plate 27, 37 since this can then be made of a less heat-tolerant material than if this were arranged, for example, on the hot end plate 28, 38. It is to be understood that the positioning means may also be formed in any other way as rod-like in order to be able to grip into a corresponding opening of the insulating body 40. In particular, the insulating bodies 40 may also hold each other in position, which can be done, for example, by suitable projections and recess, wherein optionally also the end plate 27, 37 or even 28, 38 may also have projections or recesses to enable such positioning.

Due to the fact that the insulating bodies 40 of the individual planes 22, 32 are arranged coaxially to each other, the openings of the insulating bodies 40 are also coaxially to each other so that the respective positioning means 44 can grip through all coaxially arranged insulating bodies 40 of the three insulating body planes 22, 32.

Figure 10:
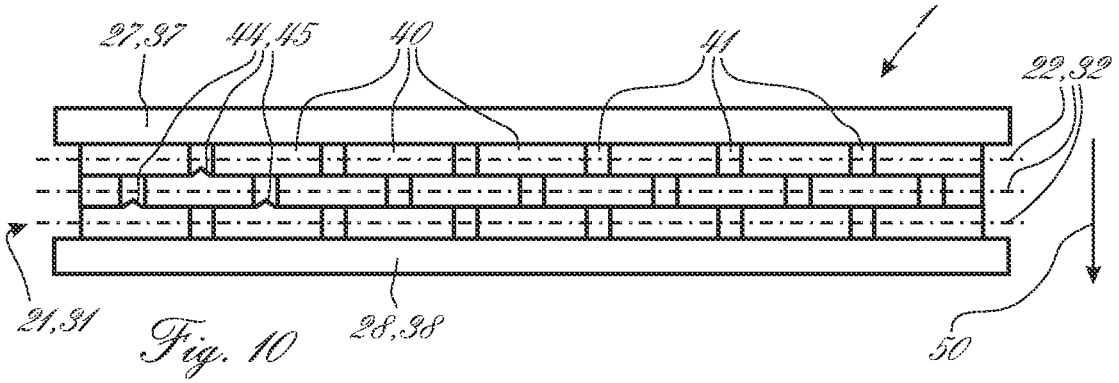
FIG. 10 shows a third die plate with spacers in schematic cross-section perpendicular to the insulating body plane.

A further exemplary embodiment in accordance with FIG. 10 differs from the previous exemplary embodiment in accordance with FIG. 9 in that the insulating bodies 40 of the individual planes 22, 32 are no longer coaxial to each other but offset to each other.

In the exemplary embodiment explained by FIG. 10, light elevations are formed on insulating bodies 40 of the lowest two planes 22, 32 as positioning means 44 and spacers 45, which are arranged in the region of the intermediate spaces 41 of the insulating body planes 40 of the adjacent insulating body planes 22, 32. In this case, these are just enough to hold the insulating bodies 40 in their position but not or not significantly impair the expansion of the insulating body 40 at high temperatures.

It is to be understood that the spacers 45, which are designed as light elevations, can be formed on insulating bodies 40 different insulating body planes 22, 32 and on different sides, such as the top side and the bottom side.

Figure 11:
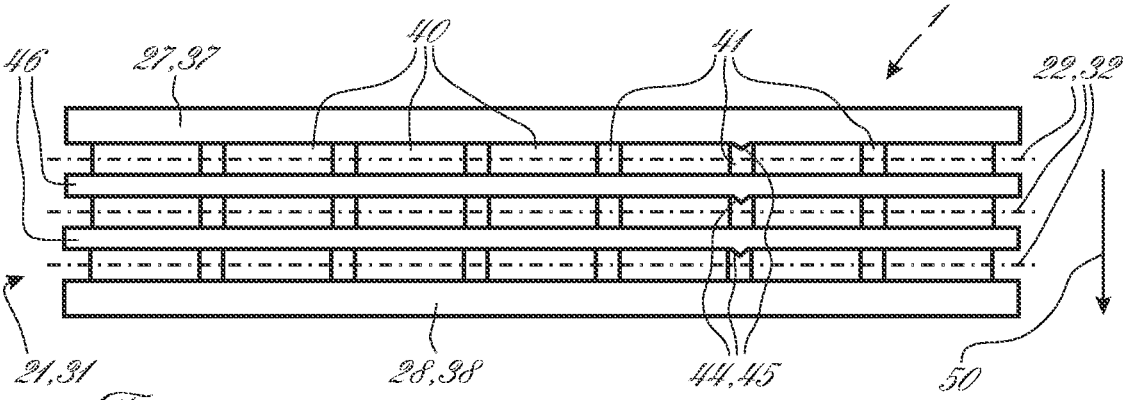
FIG. 11 shows a fourth die plate having two intermediate layers in schematic cross-section perpendicular to the insulating body plane.

In a last exemplary embodiment in accordance with FIG. 11, the die plate 1 differs from the previous exemplary embodiment in accordance with FIG. 10 in that, on the one hand, the insulating bodies 40 of the individual insulating body planes 22, 32 are arranged coaxially to each other and, additionally, an intermediate layer 46 is respectively arranged, i.e., a total of two intermediate layers 46. In addition, in the present exemplary embodiment, the positioning means 44 formed as spacers 45, which are designed as light elevations, are precisely not provided on the insulating bodies 40 but on the intermediate layers 46 and on the cold end plate 27, 37 in the region of the intermediate spaces 41, as this is indicated as an example only at one point. In this way, all insulating bodies 40 can be designed the same and do not require an additionally formed positioning means 44 on these insulating bodies 40 themselves. The positioning means 44 can be provided here via the intermediate layers 46 and the cold end plate 27, 37.

It is to be understood that all other combinations, such as the number of insulating body planes 22, 32 or the type of positioning means 44 or arrangements of the insulating body 40 to each other for example are also possible, thereby making a variety of formed die plates 1 possible.

In all exemplary embodiments, in each section through the insulating bodies 40 parallel to the insulating body plane 22, 32, a surface portion of the insulating body 40 in the total area of the insulating layer 21, 32 is at least 50%. In this way, the most effective insulation possible with the most effective force or pressure transmission can be provided. A particular advantage of such embodiments also includes a particularly long service life of the die plate 1 or the insulating body 40. It is to be understood that the surface portion can also be greater than 50% since a larger surface portion is even more favorable for the insulation with the most effective force or pressure transmission.

In addition, the insulating bodies 40 are symmetrically formed according to the exemplary embodiments of FIGS. 1 to 11, wherein the top side of the insulating body is equal to the bottom side of the insulating body 40 and all insulating bodies 40 are formed as a plate.

The plates have a height 42 (shown in FIG. 8 as an example) and a maximum width 43 and are also wider than their height. The plate-like embodiment of the insulating bodies 40 offers the possibility to be easily produced and optimal power transmission since the highest possible surface can be used for power transmission.

If, for example, a die plate 1 according to one of the exemplary embodiments in accordance with FIGS. 8 to 11 is used for a forging press in accordance with FIG. 2 or for an upper die 20 or a lower die 30 in accordance with FIG. 1, it is conceivable in a particular implementation of the exemplary embodiments that the end plates 27, 28, 37, 38 are subjected to preliminary stress in order to intercept a part of the forces acting in the forging press 10 already, thereby reducing the total load on the die plate 1.

In addition, the coaxially arranged to each other insulating bodies 40 can be aligned in accordance with FIG. 2 in the same way to have an arrangement from edge to edge, which gives a reliable hold of the plates when subjected to stress and also ensures an even distribution of force. In this way, edge breaks of the plates are also prevented, as pressure or stress increases in the area of the protruding edges can be avoided. In addition, the pressing surface can be increased as much as possible.

It is to be understood that even with particularly good insulation by the insulating layer 21, 31 or by the die plate 1 much higher temperature differences between the cold cover side 23, 33 and the hot cover side 24, 34 can be present, such as over 600 K.

Also, depending on the forged material, higher temperatures in the forming area 51 can be necessary or advised so that also at the hot die part 26, 36 higher temperatures, such as up to over 1000° C. for example, can be applied.

In addition, for a particularly good insulating effect, the insulating body 40 of the exemplary embodiments in accordance with FIGS. 1 to 11 are formed from a ceramic material. The ceramic material is designed in such a way that it meets the required requirements for insulating capacity and load capacity.

A correspondingly favorable ceramic material for the insulating body 40 has various properties.

The insulating body 40 of the present exemplary embodiments has an open porosity of 0 vol % in the present case so that this is formed accordingly gas-tight, which provides a better insulating effect. In addition, the insulating body 40 of the present exemplary embodiments has a density between 2.2 and 5.0 g/cm$^3$. In addition, the flexural strength of the insulating body 40 in the unglazed state is between 100 and 400 MPa. Furthermore, the modulus of elasticity of the insulating body 40 is between 70 and 200 GPa. Also, the insulating body 40 has an average coefficient of linear expansion at 30 to 600° C. between 5 and 10 $10^{-6}$ $K^{-1}$ and a specific heat capacity at 30 to 600° C. between 700 and 1000 $Jkg^{-1}K^{-1}$. In addition, the insulating body has a thermal conductivity between 1.5 and 5 $Wm^{-1}K^{-1}$.

Since the current flow can also have thermal effects on the insulating body 40, the insulating body 40 comprises specific resistance between $5 \cdot 10^{10}$ and $10^{12}$ Ohm·cm at 20° C. and a resistance between $5 \cdot 10^{2}$ and $10^{6}$ Ohm·cm at 600° C.

Furthermore, the insulating body 40 according to the exemplary embodiments in accordance with FIGS. 1 to 11 has a proportion of soapstone between 50 and 95%, a proportion of 50 to 85% $SiO_2$ and a proportion of 20 to 40% MgO.

Finally, the insulating body is also anisotropically shaped to avoid radial preliminary stress levels.

It is to be understood that the insulating body 40 may have very specific values or even smaller value ranges from the above-mentioned value ranges of the different material properties in the case of a particularly favorable embodiment. In addition, it is conceivable that an insulating body 40 for a suitable embodiment has only a few of the above-mentioned material properties or any combinations of said material properties can already lead to an favorable result.

Although only a few embodiments of the present invention have been shown and described, it is to be understood that many changes and modifications may be made thereunto without departing from the spirit and scope of the invention.

REFERENCE LIST

| | |
|---|---|
| 1 | die plate |
| 10 | forging press |
| 11 | column |
| 12 | press tappet |
| 13 | ejector |
| 14 | drawbar |
| 15 | semi-finished product |
| 16 | manipulator |
| 17 | upper belt |
| 18 | lower belt |
| 20 | upper die |
| 21 | insulating layer of the upper die 20 |
| 22 | insulating body plane |
| 23 | cold cover side of the upper die 20 |
| 24 | hot cover side of the upper die 20 |
| 25 | cold die part of the upper die 20 |
| 26 | hot die part of the upper die 20 |
| 27 | cold end plate of die plate 1 of the upper die 20 |
| 28 | hot end plate of the die plate 1 of the upper die 20 |
| 30 | lower die |
| 31 | insulating layer of the lower die 30 |
| 32 | insulating body plane |
| 33 | cold cover side of the lower die 30 |
| 34 | hot cover side of the lower die 30 |
| 35 | cold die part of the lower die 30 |
| 36 | hot die part of the lower die 30 |
| 37 | cold end plate of the die plate 1 of the lower die 30 |
| 38 | hot end plate of the die plate 1 of the lower die 30 |
| 40 | insulating body |
| 41 | intermediate space |
| 42 | height of the insulating body 40 |
| 43 | maximum width of the insulating body 40 |
| 44 | positioning means |
| 45 | spacer |
| 46 | intermediate layer |
| 50 | pressing direction |
| 51 | forming area |
| 55 | maintenance opening |
| 56 | maintenance door |
| 58 | vacuum forging chamber |

What is claimed is:

1. An insulating die plate (1) comprising first and second end plates (27, 28, 37, 38) arranged in parallel with one another; and an insulating layer (21, 31) arranged between the first and second end plates (27, 28, 37, 38), which comprises ceramic insulating bodies (40), wherein an insulating body plane (22, 32) arranged at least parallel to the end plates (27, 28, 37, 38) is defined for the insulating layer (21, 31), wherein the insulating bodies (40) are arranged spaced apart next to one another on the insulating body plane (22, 32), whereby intermediate spaces (41) are arranged on the insulating body plane (22, 32) between the insulating bodies (40), wherein a total area of the insulating layer (21, 31) comprises at least surface portions of the insulating bodies (40) and surface portions of the intermediate spaces (41), wherein in each section through the insulating bodies (40) parallel to the insulating body plane (22, 32), a surface portion of the insulating bodies (40) in the total area of the insulating layer (21, 31) is at least 50%, and wherein the insulating bodies (40) are symmetrically formed, wherein the top side of the insulating body (40) is equal to the bottom side of the insulating body (40) and all insulating bodies (40) are designed as a plate, wherein the plates have a height (42) and a maximum width (43) and are designed to be wider than their height, and wherein within the insulating layer (21, 31) ceramic insulating bodies (40) are arranged on at least two insulating body planes (22, 32).

2. The die plate (1) according to claim 1, wherein the end plates (27, 28, 37, 38) are subjected to preliminary stress.

3. The die plate (1) according to claim 1, wherein a plurality of insulating bodies (40) are arranged on each insulating body plane (22, 32).

4. The die plate (1) according to claim 1, wherein, within the insulating layer (21, 31) ceramic insulating bodies (40) are arranged on at least three insulating body planes (22, 33).

5. The die plate (1) according to claim 4, wherein the insulating bodies (40) of the individual planes are arranged coaxially to each other and/or that the insulating bodies (40) are aligned equally.

6. The die plate (1) according to claim 4, wherein an intermediate layer (46) is arranged between the insulating bodies arranged on top of each other (40).

7. A forging press (10) for pressing a semi-finished product (15) in one pressing direction (17) comprising:

a press tappet (12);

at least one drawbar (14);

at least one upper die (20); and at least one lower die (30);

wherein each of the dies (20, 30) comprises a cold die part (25, 35), and a hot die part (26, 36), wherein each of the dies (20, 30) comprises the insulating die plate (1) according to claim 1 arranged perpendicular to the pressing direction (17), wherein the die plate (1) is respectively arranged between the cold die part (25, 35) and the hot die part (26, 36), wherein each of the die plates (1) is arranged between a cold cover side (23, 33) arranged on the side of the cold die part (25, 35) and a hot cover side (24, 34) arranged on the side of the hot die part (26, 36).

8. A forging press (10) for pressing a semi-finished product (15) in one pressing direction (17) comprising:

a press tappet (12);

at least one drawbar (14);

at least one upper die (20);

at least one lower die (30);

wherein each of the dies (20, 30) comprises a cold die part (25, 35), and a hot die part (26, 36), wherein each of the dies (20, 30) comprise an insulating layer (21, 31) arranged perpendicular to the pressing direction (17), wherein the insulating layer (21, 31) is respectively arranged between the cold die part (25, 35) and the hot die part (26, 36), wherein each of the insulating layers (21, 31) is arranged between a cold cover side (23, 33) situated on the side of the cold die part (25, 35) and a hot cover side (24, 34) situated on the side of the hot die part (26, 36), wherein the insulating layer (21, 31) comprises ceramic insulating bodies (40), wherein an insulating body plane (22, 32) arranged at least parallel to the end plates (27, 28, 37, 38) is defined for the insulating layer (21, 31), wherein the insulating bodies (40) are arranged spaced apart next to one another on the insulating body plane (22, 32), whereby, on the insulating body plane (22, 32) between insulating bodies (40), intermediate spaces (41) are formed, wherein a total area of the insulating layer (21, 31) comprises at least surface portions of the insulating bodies (40) and surface portions of the intermediate spaces (41), wherein a plurality of insulating bodies (40) are arranged in each insulating body plane (22, 32), wherein, in each section through the insulating bodies (40) parallel to the insulating body plane (22, 32), a surface portion of the insulating body (40) in the total area of the insulating layer (21, 31) is at least 50%, and wherein the insulating bodies are symmetrically formed, wherein the top side of the insulating body is equal to the bottom side of the insulating body and all insulating bodies are designed as plates, wherein the plates (42) have a height and a maximum width (43) and are wider than their height, and wherein within the insulating layer (21, 31) ceramic insulating bodies (40) are arranged on at least two insulating body planes (22, 32).

9. The forging press (10) according to claim 8, wherein, within the insulating layer (21, 31), ceramic insulating bodies (40) are arranged on at least three insulating body planes (22, 33).

10. The forging press (10) according to claim 9, wherein the insulating bodies (40) of the individual planes are arranged coaxially to each other and/or that the insulating bodies (40) are aligned equally.

11. The forging press (10) according to claim 9, wherein an intermediate layer (46) is arranged between the insulating bodies arranged on top of each other (40).

* * * * *